US008182053B1

(12) United States Patent
Schacher et al.

(10) Patent No.: US 8,182,053 B1
(45) Date of Patent: May 22, 2012

(54) BATHROOM CABINET WITH EXTENDABLE MIRRORS

(76) Inventors: Joel Schacher, Gilbert, AZ (US); Tina Schacher, Gilbert, AZ (US)

( * ) Notice: Subject to any disclaimer, the term of this patent is extended or adjusted under 35 U.S.C. 154(b) by 321 days.

(21) Appl. No.: 12/469,754

(22) Filed: May 21, 2009

Related U.S. Application Data

(60) Provisional application No. 61/054,999, filed on May 21, 2008.

(51) Int. Cl.
*A47B 67/00* (2006.01)

(52) U.S. Cl. ..... 312/227; 312/334.24

(58) Field of Classification Search ..... 312/226, 312/227, 291, 248, 326, 329, 224, 225, 334.23–334.28, 312/334.31, 334.33, 350, 351; 49/163, 164, 49/166
See application file for complete search history.

(56) References Cited

U.S. PATENT DOCUMENTS

| | | | | | |
|---|---|---|---|---|---|
| 1,380,222 | A * | 5/1921 | Lichtenberg | 312/246 |
| 1,645,058 | A * | 10/1927 | King | 362/129 |
| 1,798,800 | A * | 3/1931 | MacKnight | 312/198 |
| 1,876,407 | A * | 9/1932 | Frazier | 312/227 |
| 2,199,731 | A * | 5/1940 | Pryne | 312/310 |
| 2,489,418 | A * | 11/1949 | Jones | 362/141 |
| 2,578,096 | A * | 12/1951 | Smith | 312/227 |
| 2,678,252 | A * | 5/1954 | Swearingen | 312/223.5 |
| 2,763,527 | A * | 9/1956 | Berger | 312/325 |
| 2,773,728 | A * | 12/1956 | La Barre | 312/227 |
| 2,847,266 | A * | 8/1958 | Biere | 312/227 |
| 3,140,134 | A * | 7/1964 | Nairn | 312/204 |
| 3,244,464 | A * | 4/1966 | McMurtrie et al. | 312/227 |
| 5,399,008 | A * | 3/1995 | Vann, Jr. | 312/227 |
| 6,092,884 | A * | 7/2000 | Katz | 312/225 |
| 7,665,809 | B1 * | 2/2010 | Giles et al. | 312/204 |
| 2006/0006772 | A1 * | 1/2006 | Galindo et al. | 312/227 |

FOREIGN PATENT DOCUMENTS

JP 2006124919 A * 5/2006

* cited by examiner

*Primary Examiner* — Darnell Jayne
*Assistant Examiner* — Patrick Hawn
(74) *Attorney, Agent, or Firm* — Kenneth L Tolar

(57) ABSTRACT

A bathroom cabinet includes a housing having an open face in communication with an interior storage compartment. A pivotal door is positioned over the open face to provide selective access to the interior chamber. The door includes a front mirror similar to that found on conventional bathroom cabinets. Behind the front mirror is an extendable mirror assembly including a slidable magnifying mirror and an auxiliary mirror. A user can extend and position the mirror assembly as necessary to closely view a reflected image without leaning or bending.

5 Claims, 2 Drawing Sheets

BATHROOM CABINET WITH EXTENDABLE MIRRORS

CROSS REFERENCE TO RELATED APPLICATIONS

This application is entitled to the benefit of provisional application No. 61/054,999 filed on May 21, 2008, the specification of which is incorporated herein by reference.

BACKGROUND OF THE INVENTION

The present invention relates to a bathroom cabinet having extendable mirrors that allow a user to more easily view a reflected image.

DESCRIPTION OF THE PRIOR ART

Most bathrooms are equipped with a mirror that is mounted immediately above a sink. To get a closer view of one's image, he or she must lean toward the mirror, which places a significant strain on the neck and back. Accordingly, there is currently a need for a device that allows a user to more easily view closeup images of the user's body. The present invention addresses this need by providing a bathroom cabinet having extendable standard and magnifying mirrors that can be easily positioned in front of a user without bending or leaning.

SUMMARY OF THE INVENTION

The present invention relates to a bathroom cabinet comprising a housing having an open face in communication with an interior storage compartment. A pivotal door is positioned over the open face to provide selective access to the interior chamber. The door includes a front mirror similar to that found on conventional bathroom cabinets. Behind the front mirror is an extendable mirror assembly including a slidable magnifying mirror and an auxiliary mirror. A user can extend and position the mirror assembly as necessary to closely view a reflected image without leaning or bending.

It is therefore an object of the present invention to provide a bathroom cabinet having an extendable mirror assembly.

It is another object of the present invention to provide a bathroom cabinet that allows a user to more easily view reflected images.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
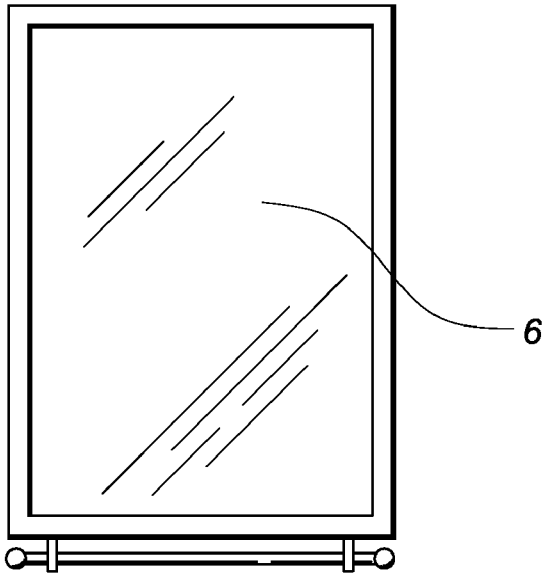
FIG. 1 is a front, plan view of the bathroom cabinet according to the present invention.
Figure 2:
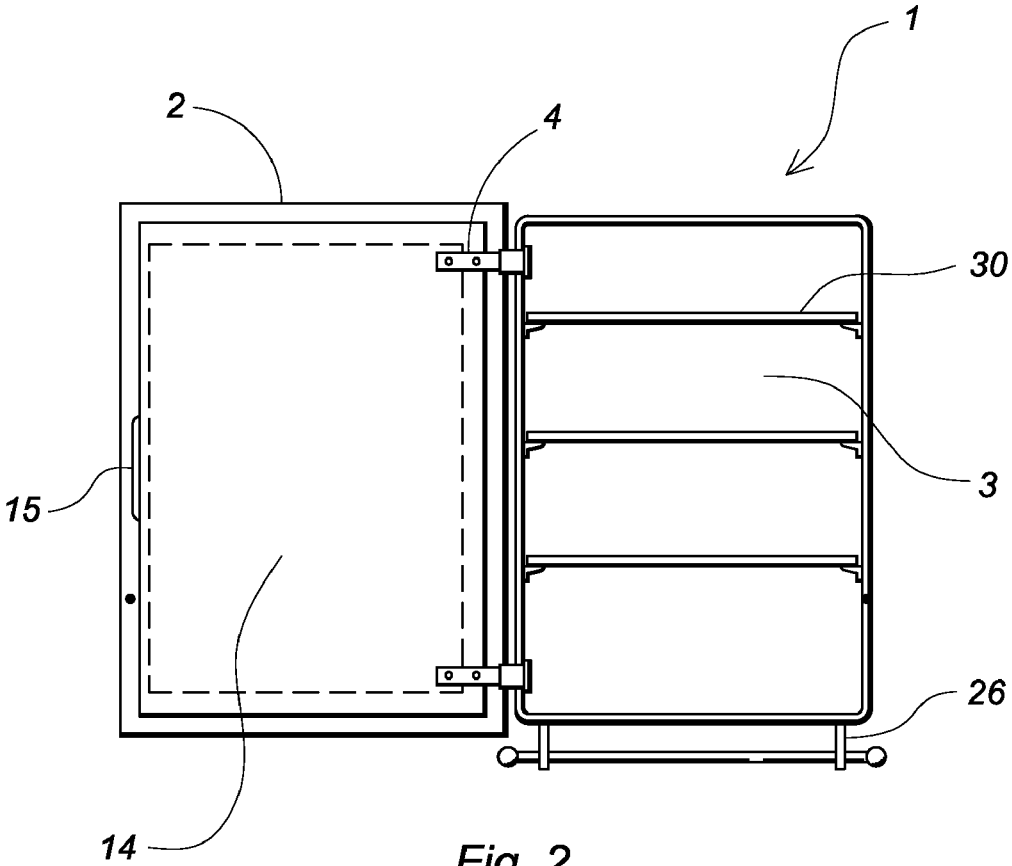
FIG. 2 depicts the cabinet of FIG. 1 with the door in an open position.
Figure 3:
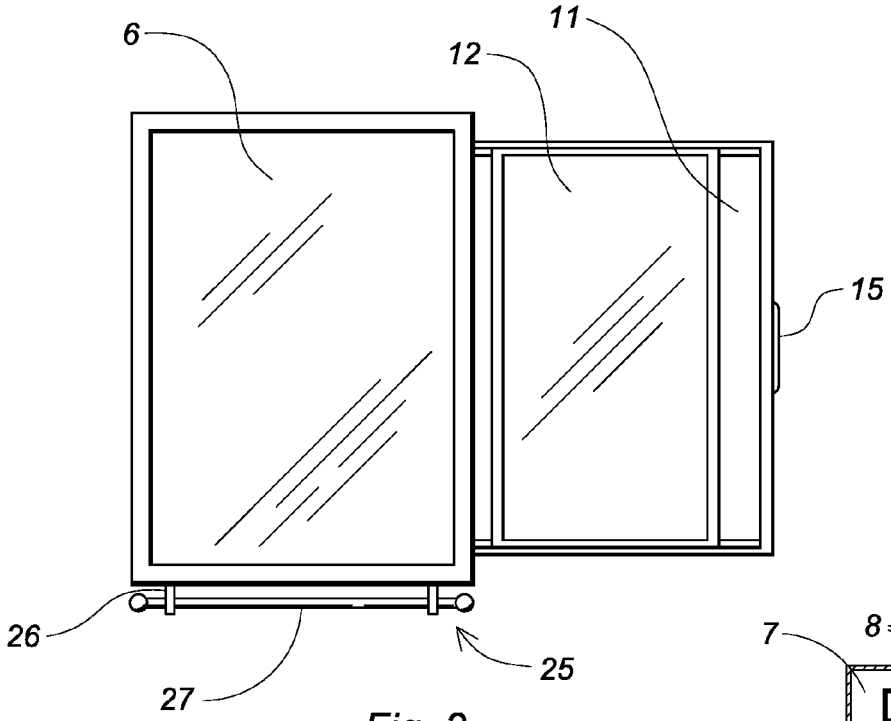
FIG. 3 depicts the cabinet with the mirrors extended therefrom.
Figure 4:
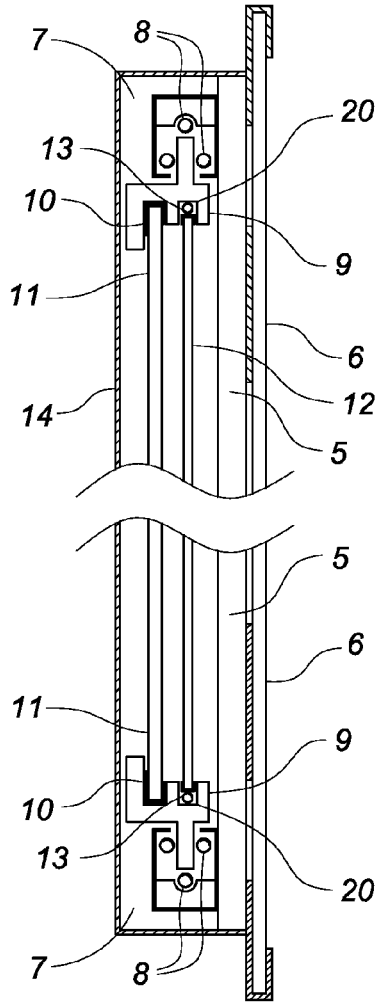
FIG. 4 is a side, sectional detailed view of the extendable mirror assembly.

The present invention relates to a bathroom cabinet comprising a housing 1 having a rear wall, a pair of sidewalls, a top wall, a bottom wall and an open face 3 in communication with an interior storage compartment. Within the compartment are a plurality of horizontal shelves 30 for supporting toiletries and other items. A door assembly 2 is pivotally secured to the housing with specially-designed (Eurodesign door) hinges 4 that allow the door to pivot over the open face; the hinges also allow the door to open to at least 125 degrees relative to the face to facilitate access to the interior chamber. A towel rack 25 includes outwardly extending, arcuate brackets 26 secured to a lower edge of the housing that retain a horizontal towel support bar 27. The arcuate brackets space the support bar a predetermined distance from the wall on which the cabinet is mounted.

The door assembly is formed of a door panel 5 having a front surface and a rear surface. Attached to the front surface is a stationary mirror 6 similar to that found on conventional bathroom cabinets. Attached to the rear surface is an extendable mirror assembly including an upper retainer 7, proximal the upper edge of the panel, and a lower retainer, proximal the lower edge. Each retainer slidably receives a dual frame 9 having a first channel 10 fixedly encompassing a standard auxiliary mirror 11. A ball bearing assembly 8 within the retainer assures smooth, uninhibited retraction and extension of the dual frame. A magnifying mirror 12 and an associated bearing system 13 are mounted within a second channel 20 allowing the magnifying mirror to move within the dual frame relative to the auxiliary mirror. The entire extendable mirror assembly is concealed within a rigid cover 14. A magnetic catch is attached to the housing to engage a mating ferromagnetic latch on the cover 14 to releasably secure the door assembly in a closed position. On a side edge of the auxiliary mirror is a spring-biased handle 15 that selectively seats within a mating depression.

Accordingly, when slight pressure is applied to the handle, it deploys from the depression and may be grasped to extend and retract the mirror assembly. The user then extends the auxiliary mirror and the attached dual frame assembly to a position adjacent the stationary mirror. When the assembly is initially extended, the magnifying mirror substantially obscures the auxiliary mirror; however, if the magnifying mirror is unnecessary, it can be easily retracted within the cover to expose the auxiliary mirror. Therefore, the user can extend and position the mirror assembly as necessary to closely view a reflected image without leaning or bending.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A bathroom cabinet comprising:

a housing having a lower surface and an open face in communication with an interior storage compartment;

a door pivotally secured to said housing for selectively overlaying the open face, said door having a front surface and a rear surface;

a stationary mirror attached to the front surface of said door;

a supplemental mirror assembly attached to the rear surface of said door, said supplemental mirror assembly extendable and retractable relative to said door to provide a supplemental reflective surface adjacent said stationary mirror, wherein said supplemental mirror assembly includes an upper retainer on the rear surface of said stationary mirror, proximal an upper end; a lower retainer on the rear surface of said stationary mirror, proximal a lower end; a first dual frame slidably received within the upper retainer; a second dual frame slidably received within the lower retainer, each of said first dual frame and said second dual frame having a first channel fixedly receiving an auxiliary mirror and a second channel slidably receiving a magnifying mirror allowing the magnifying mirror to move within each of said first dual frame and said second dual frame relative to the auxiliary mirror.

2. The bathroom cabinet according to claim 1 wherein said supplemental mirror assembly is concealed within a rigid cover.

3. The bathroom cabinet according to claim 2 further comprising:

a magnetic catch attached to said housing;

a ferromagnetic latch positioned on said cover to engage said catch to releasably secure the door assembly in a closed position.

4. The bathroom cabinet according to claim 3 further comprising a spring-biased handle on a side edge of the auxiliary mirror that selectively seats within a depression.

5. The bathroom cabinet according to claim 4 further comprising outwardly extending, arcuate brackets secured to the lower edge of the housing that retain a horizontal towel support bar a predetermined distance from a support surface on which the cabinet is mounted.

* * * * *